US012193615B2

(12) United States Patent
Lewis et al.

(10) Patent No.: US 12,193,615 B2
(45) Date of Patent: Jan. 14, 2025

(54) DISPENSER WITH DROP DOWN FEATURE AND METHOD

(71) Applicant: Kimberly-Clark Worldwide, Inc., Neenah, WI (US)

(72) Inventors: Richard P. Lewis, Marietta, GA (US); Edward A. Raleigh, Lodi, WI (US); Jeffrey J. Brickl, Prairie Du Sac, WI (US); Matthew T. Woerpel, Lodi, WI (US); Robert Godfrey, Monona, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/913,218

(22) PCT Filed: Apr. 30, 2020

(86) PCT No.: PCT/US2020/030625
§ 371 (c)(1),
(2) Date: Sep. 21, 2022

(87) PCT Pub. No.: WO2021/221643
PCT Pub. Date: Nov. 4, 2021

(65) Prior Publication Data

US 2023/0130085 A1 Apr. 27, 2023

(51) Int. Cl.
*A47K 10/36* (2006.01)
*A47K 10/38* (2006.01)

(52) U.S. Cl.
CPC ..... *A47K 10/3687* (2013.01); *A47K 10/3827* (2013.01); *A47K 2010/3681* (2013.01); *A47K 2010/3854* (2013.01)

(58) Field of Classification Search
CPC ..... A61K 10/3827; A61K 2010/3854
See application file for complete search history.

(56) References Cited

U.S. PATENT DOCUMENTS 2,872,264 A * 2/1959 Nehring ..... A47K 10/3827 242/560.3
3,084,006 A * 4/1963 Roemer ..... A47K 10/3827 312/34.22

(Continued)

FOREIGN PATENT DOCUMENTS

JP 2006280491 A 10/2006
KR 101287221 B1 7/2013
WO WO2008129572 A1 10/2008

OTHER PUBLICATIONS

European Search Report Corresponding to Application No. 20933676.7 on Dec. 7, 2023.

(Continued)

*Primary Examiner* — William A. Rivera
(74) *Attorney, Agent, or Firm* — Dority & Manning, P.A.

(57) ABSTRACT

A dispenser is disclosed that facilitates loading of new rolls of material and the removal of empty cores. The dispenser includes a cradle roller spaced from a pair of abutment rollers. As a roll of material is dispensed, the diameter of the roll reduces causing the roll to drop from the cradle roller to a collection device. A transfer assembly pivots with the roll so that the sheet material continues to be dispensed from the dispenser without interruption. Once the roll of material drops to the collection device, a new roll of material can be loaded into the dispenser for automatic transfer to the new roll once the first roll of material has been completely depleted.

20 Claims, 7 Drawing Sheets

(56) References Cited

U.S. PATENT DOCUMENTS

| | | | | |
|---|---|---|---|---|
| 4,358,169 | A * | 11/1982 | Filipowicz | A47K 10/3637 225/8 |
| 4,403,748 | A | 9/1983 | Cornell | |
| 4,406,421 | A * | 9/1983 | Schultz | A47K 10/36 226/129 |
| 4,944,466 | A | 7/1990 | Jespersen | |
| 5,558,302 | A | 9/1996 | Jespersen | |
| 5,601,253 | A * | 2/1997 | Formon | A47K 10/3827 242/595.1 |
| 6,161,795 | A * | 12/2000 | Skerrett | A47K 10/36 242/595.1 |
| 6,224,010 | B1 | 5/2001 | Morand | |
| 6,302,351 | B1 | 10/2001 | Omdoll et al. | |
| 7,270,292 | B2 | 9/2007 | Rasmussen | |
| 7,296,765 | B2 | 11/2007 | Rodrian | |
| 7,398,944 | B2 | 7/2008 | Lewis et al. | |
| 8,800,415 | B2 | 8/2014 | Osborne et al. | |
| 9,326,648 | B2 | 5/2016 | Trampolski | |
| 9,661,958 | B2 | 5/2017 | Moody et al. | |
| 10,299,638 | B2 | 5/2019 | Henson et al. | |
| 2002/0050544 | A1 | 5/2002 | Standland et al. | |
| 2013/0334272 | A1 * | 12/2013 | Granger | A47K 10/38 225/88 |
| 2016/0051098 | A1 * | 2/2016 | Marietta-Tondin | A47K 10/3827 225/106 |
| 2017/0188760 | A1 | 7/2017 | Henson et al. | |
| 2019/0380546 | A1 | 12/2019 | Sexton et al. | |

OTHER PUBLICATIONS

Georgia-Pacific Professional, OptiServ® Dispenser: Loading and Stub Roll Feature, 1 Page, https://www.youtube.com/watch?v=ptX86UtHbbM.

International Search Report and Written Opinion for PCT/US2020/030625 dated Jan. 22, 2021, 13 pages.

Translation of Korean Office Action Corresponding to Application No. 10-2022-7040588 on Oct. 18, 2024.

* cited by examiner

DISPENSER WITH DROP DOWN FEATURE AND METHOD

RELATED APPLICATION

The present application is the National Stage entry of International Patent Application No. PCT/US2020/030625, published as WO 2021/221643, which is incorporated herein by reference in its entirety.

BACKGROUND

Washrooms in commercial and residential buildings typically include products such as toilet tissue, paper towels, diapers, feminine products, liquid products such as soap, and aerosol products such as air fresheners. These products are typically housed by a dispenser and are dispensed as needed by the user. Currently, janitors or maintenance personnel roam the buildings in which they are working to service the washrooms, or the janitors or maintenance personnel are sent to service a particular washroom or dispenser after a problem has occurred. Fixing of a problem with the washroom after the fact results in numerous tenant complaints and overall dissatisfaction.

Additionally, janitorial or maintenance personnel resources are focused on servicing emergencies and are pulled away from other tasks. Additionally, waste of product is high since janitors or maintenance personnel tend to change out products before the dispensers are empty in order to avoid running out of the products before the janitors or maintenance personnel return to once again service the dispensers.

In view of the above, those skilled in the art have spent considerable time designing smart dispensers that are intended to overcome the problems noted above. For instance, dispensers have been designed that can monitor product usage and product levels in order to prevent waste. In addition, electronic towel dispensers have been designed that automatically dispense a metered length of towel material upon sensing the presence of a user. This type of dispenser has become known in the art as a "hands-free" dispenser in that it is not necessary for the user to manually activate or otherwise handle the dispenser to initiate a dispense cycle. The control systems and mechanical aspects of hands-free dispensers are wide and varied.

No matter how many features and controls are built into a dispenser, however, product still needs to be replenished manually. For example, when servicing a conventional paper towel dispenser, a service person typically must remove any empty cores from the dispenser; remove any partially exhausted roll from the main roll support arms and install it on a stub roll support arm; and install a new roll of sheet material on the main roll support arm. In many instances, the service person will discard partially used rolls instead of having to move them to a stub roll support arm leading to a significant amount of wasted product. In addition, threading the leading edge of a new roll of material into a paper towel dispenser can sometimes be a complex process that can lead to user error. The above operations can often take a substantial amount of time, especially when a restroom facility or building contains many different paper towel dispensers.

In view of the above, further improvements are still needed in dispensers for sheet materials. In particular, a need exists for a dispenser with a dispenser mechanism that can completely dispense and exhaust a roll of material without having to manually move the roll within the dispenser. A need also exists for a dispenser for sheet products in which new rolls can be easily loaded and empty cores can be easily removed.

SUMMARY

In general, the present disclosure is directed to a dispenser for a sheet material, such as paper towels, that reduces the amount of time and effort needed to load new product into the dispenser and to remove any empty cores.

For example, in one aspect the present disclosure is directed to a dispenser for sheet materials. The dispenser includes a housing having an interior volume so as to retain at least one roll of sheet material. The dispenser further includes a dispensing mechanism contained within the housing for dispensing the sheet material. The dispensing mechanism includes a cradle device for holding a roll of sheet material. A collection device is positioned below the cradle device. The collection device is positioned to receive a roll of sheet material that has been at least partially exhausted. The dispenser mechanism further includes a pair of spaced apart abutment devices spaced from the cradle device. When a roll of sheet material is loaded onto the cradle device, the roll rests against both the cradle device and the abutment devices as the sheet of material is dispensed. For example, in one embodiment, the abutment devices comprise spaced apart rollers that rotate as the roll of sheet material is dispensed through the dispenser.

As a roll of sheet material loaded on the cradle device and abutment devices is dispensed, the roll reduces in diameter. In accordance with the present disclosure, the diameter of the roll of sheet material reduces until the roll has a size that permits the roll to drop between the cradle device and the abutment devices and onto the collection device.

The dispenser mechanism further includes a transfer assembly that guides and drives a sheet of material from a roll of sheet material loaded in the dispenser out through a dispensing opening. The transfer assembly includes a transfer shoe spaced from a drive roller. The transfer shoe guides the sheet material into operative engagement with the drive roller for dispensing the sheet material from the dispenser. The transfer assembly is configured to pivot or move when a roll of sheet material drops between the cradle device and the abutment devices for continuing to dispense sheet material from the partially exhausted roll of material located on the collection device. In this manner, as a roll of material is dispensed from within the dispenser, the roll of material changes position within the dispenser without any manual interaction and while the sheet material is continuously dispensed. Consequently, a new roll of material can be loaded in the dispenser quickly and efficiently without having to manipulate the partially exhausted roll of material.

The cradle device as described above can include a cradle roller rotatably mounted on an axial member. The cradle device can include spaced apart segregator panels attached to the cradle roller. The segregator panels can be spaced apart a distance sufficient for a roll of sheet material to be positioned therebetween. The cradle device can further include a latch device that only permits the cradle roller to rotate towards the transfer assembly as a roll of sheet material is depleted and drops onto the collection device. In this manner, as the diameter of the roll of material reduces to a point where the roll of material can pass between the cradle device and the abutment devices, gravity causes the partially exhausted roll of material to rotate the cradle device causing the partially exhausted roll to fall onto the collection device.

The collection device can comprise an arc-shaped pan that partially surrounds the cradle device. The collection device can have a shape sufficient to hold a plurality of empty cores collected from fully dispensed rolls of sheet material.

The transfer assembly can include at least one belt that extends around the drive roller and the transfer shoe. The belt can be driven by the drive roller and, when pressed against a sheet material, can facilitate movement of the sheet material through the dispenser. The transfer shoe can be a transfer roller that rotates as the at least one belt is moved. The transfer shoe can have a size or length that passes in between the abutment devices when a roll of material drops from the cradle device to the collection device. For example, the transfer shoe can move from a first position to a second position when the roll of sheet material drops onto the collection device. In one embodiment, the transfer shoe can be biased towards the first position. As the roll of material drops onto the collection device, the sheet material can push against the transfer shoe and cause the transfer shoe to move to the second position which allows the sheet material to be dispensed without interruption. When the roll of material is completely depleted, the transfer shoe can then pivot back to the first position for engaging a new roll of material. For example, in one embodiment, the dispensing mechanism can further include a feed device for receiving a free end of a roll of sheet material loaded onto the cradle device. The feed device can be configured to automatically feed the free end of the roll of sheet material into the transfer device when the transfer device moves back into the first position after a roll of material has been completely depleted.

The present disclosure is also directed to a method for dispensing a roll of sheet material. The method includes loading a roll of sheet material onto a cradle device. The roll of material rests against a surface of the cradle device and against a pair of spaced apart abutment devices. The sheet material is dispensed through a dispensing opening and wherein, as the roll of material dispenses, a diameter of the roll of material decreases to an extent that the roll of material drops in between the cradle device and the abutment devices and onto a collection device. The method further includes continuously dispensing the roll of material from the collection device until the roll of material is completely depleted.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
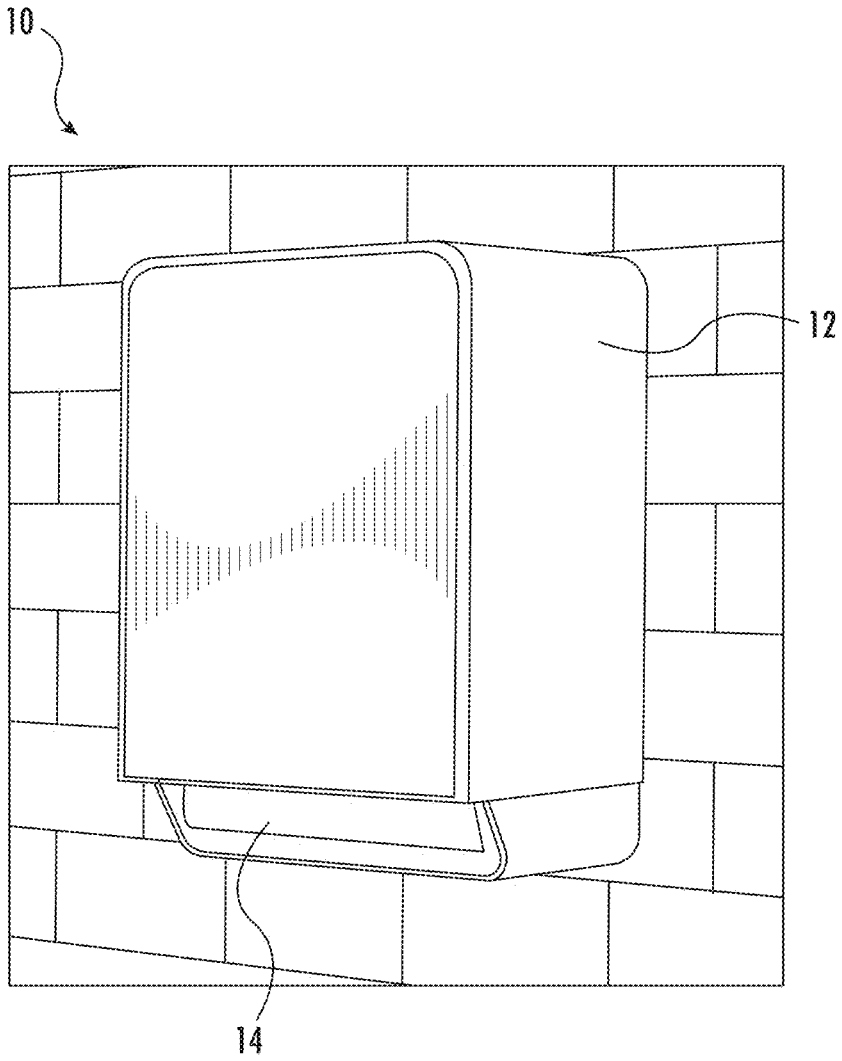
FIG. 1 is a perspective view of one embodiment of a dispenser that may be made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a dispenser for sheet materials and/or to a dispenser assembly. The dispenser of the present disclosure allows for easy loading of new rolls of sheet material and for removing empty cores. The design of the present disclosure also permits for continuous dispensing of a roll of material as the diameter of the roll reduces until completely exhausted. In accordance with the present disclosure, the dispenser is configured to permit movement of a partially exhausted or dispensed roll of material from a loading position to a partially dispensed position wherein continuous dispensing of the sheet material occurs during the transition without any manual manipulation.

More particularly, the dispenser of the present disclosure provides a means to support a full roll of product on a cradle in the back and on a pair of spaced apart abutment devices in the front. The roll of sheet material dispenses product form the loading position and decreases in diameter as material is dispensed. When the roll reaches a suitable smaller diameter, the roll drops within the dispenser between the cradle and the abutment devices onto a collection device. As the roll of sheet material drops, the sheet material automatically positions a transfer assembly to not only allow loading of a new roll of material within the dispenser but also to allow for the material from the dropped roll to be continuously dispensed until the roll is completely depleted. Once the roll is completely depleted, the transfer assembly moves back to its initial position and engages the leading edge of a new roll of material.

Referring to FIGS. 1-13, for instance, one embodiment of a dispenser made in accordance with the present disclosure is shown. As shown in FIG. 1, the dispenser 10 can include a dispenser housing 12 that defines an interior volume so as to retain at least one roll of material. The housing can also cover a dispensing mechanism for dispensing the roll of material in a sheet-by-sheet fashion. For example, the housing 12 can define a dispensing opening 14 that dispenses the sheet material to a user.

Figure 2:
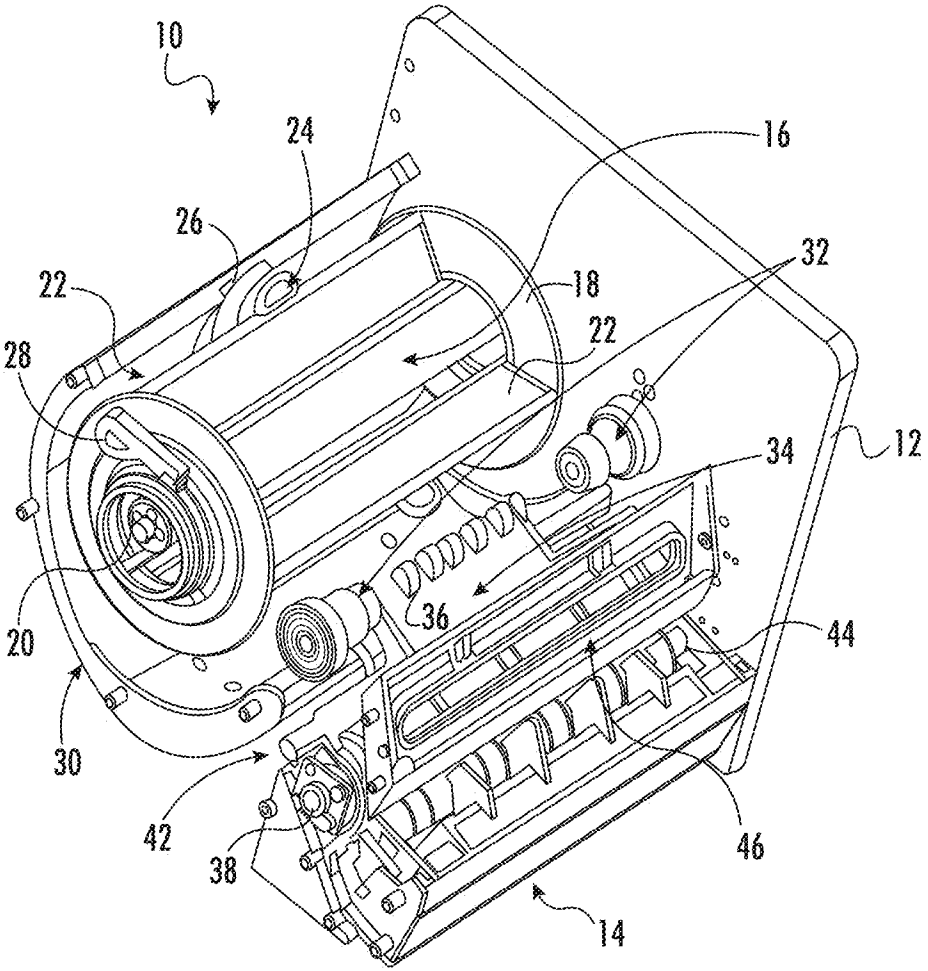
FIG. 2 is a perspective view of one embodiment of a dispensing mechanism made in accordance with the present disclosure.
Figure 5:
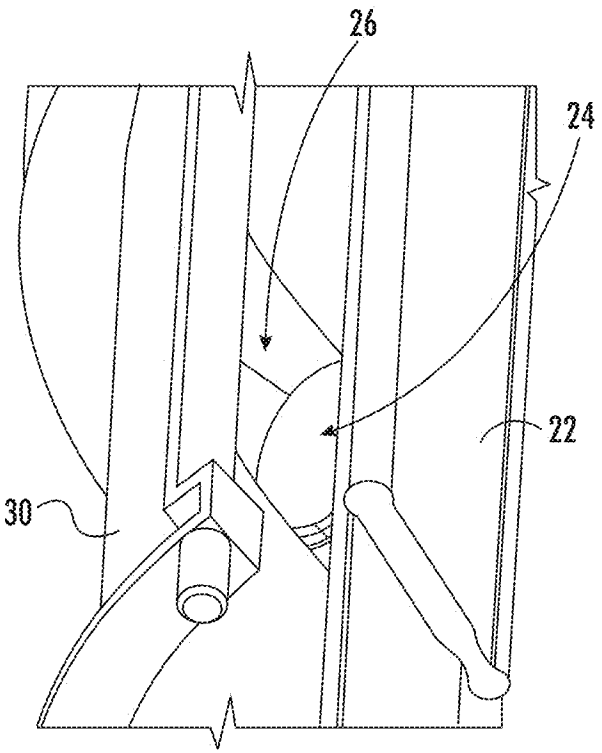
FIG. 5 is a perspective view of a portion of the dispensing mechanism illustrated in FIG. 4.
Figure 4:
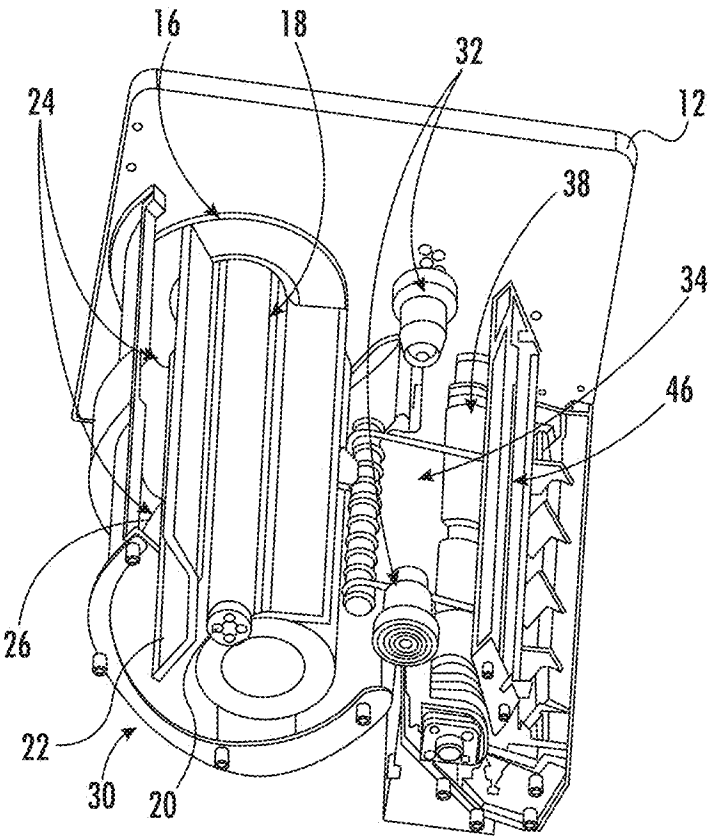
FIG. 4 is another perspective view of the dispensing mechanism illustrated in FIG. 2.

Referring to FIG. 2, one embodiment of a dispensing mechanism that may be contained in the dispenser 10 in accordance with the present disclosure is shown. The dispensing mechanism includes a cradle device 16 that is designed to receive a roll of sheet material as shown in FIG.

6. The cradle device 16 includes a cradle roller 18 rotatably mounted on an axial member 20. The cradle roller 18 includes a plurality of segregator panels 22. The segregator panels 22 are spaced around the circumference of the cradle roller 18. The segregator panels 22 are spaced apart so as to allow a full roll of material to be placed between adjacent segregator panels and rest on the cradle roller 18.

As shown in FIG. 2, each segregator panel 22 can include a segregator panel tab 24. The segregator panel tab 24 projects outward from the circumference of the cradle roller 18.

Positioned below the cradle device 16 is a collection device 30. As shown in FIG. 2, the collection device 30 can have an arc-shape that partially surrounds the cradle roller 18. The collection device 30 is also located below the cradle device 16. As will be described in greater detail below, the collection device in the shape of an arc-shaped pan has a size and is positioned so as to receive partially unwound rolls of sheet material from the cradle device 16 and to collect empty cores once a roll of sheet material has been completely depleted. As shown particularly in FIGS. 4 and 5, the collection device 30 defines an alignment channel 26. The alignment channel 26 is for receiving the segregator panel tabs 24 as the cradle roller 18 rotates. The collection device 30 and the cradle roller 18 can be positioned in engagement with each other such that there is always at least one segregator panel tab 24 located within the alignment channel 26. In this manner, the cradle roller 18 is prevented from shifting or coming out of alignment in the axial direction.

In the embodiment illustrated in the figures, the cradle roller 18 includes three segregator panels 22. It should be understood, however, that the cradle roller 18 can include less or more segregator panels 22. For instance, the cradle roller 18 can include between about two and about eight segregator panels. In the embodiment illustrated, however, the use of three segregator panels 22 has been found to be optimum.

The cradle device 16, as shown in FIG. 2, can further include a latch device 28. The latch device 28 can be mounted to the housing 12 and can engage the cradle roller 18. The latch device 18 is any suitable device that allows the cradle roller 18 to rotate in a clockwise direction but prevents rotation in a counter-clockwise direction. In the embodiment illustrated, the latch device 28 includes stop members that engage tabs on the cradle roller.

Figure 6:
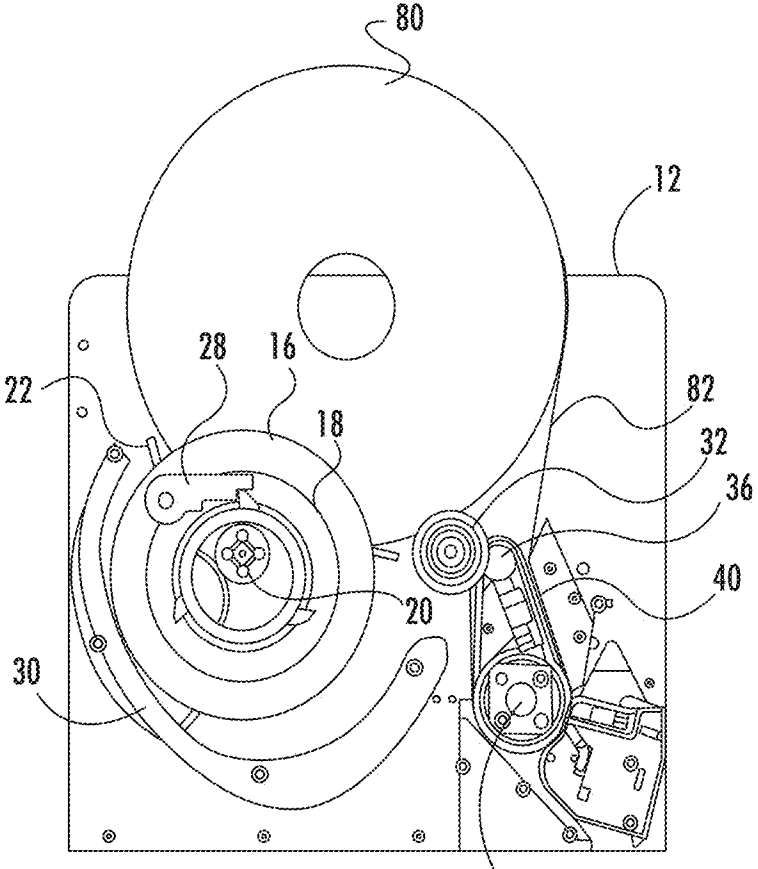
FIG. 6 is a side view of the dispensing mechanism illustrated in FIG. 2.

As shown in FIG. 2, the dispensing mechanism can further include a pair of spaced apart abutment devices 32. As shown in FIG. 6, when a full roll of sheet material 80 is loaded onto the dispensing mechanism, the roll of sheet material 80 rests against the cradle roller 18 and the abutment devices 32. In one aspect, the abutment devices 32 are rollers that rotate as a sheet material 82 is dispensed from the roll 80. The abutment devices 32 are spaced from the cradle roller 18 leaving a gap or space therebetween that allows a partially unwound roll to fall in between the two components and onto the collection device 30.

Figure 3:
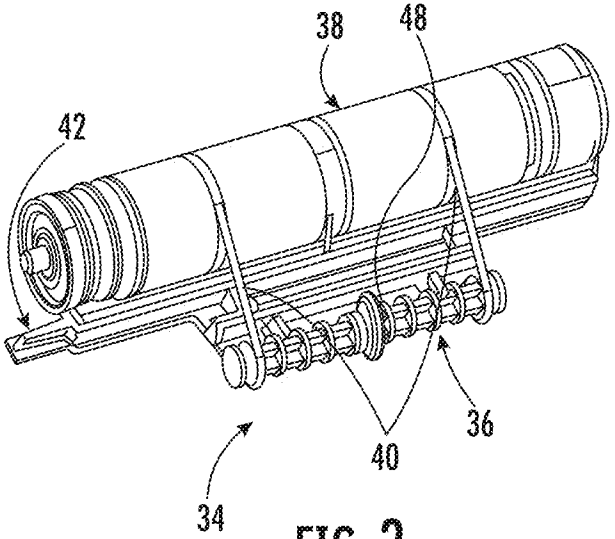
FIG. 3 is a perspective view of a transfer assembly that may be used with the dispensing mechanism illustrated in FIG. 2.

The dispensing mechanism further includes a transfer assembly 34 that is particularly shown in FIG. 3. The transfer assembly 34 guides a sheet material from a roll of sheet material loaded on the cradle device 16 out through the dispensing opening 14. Referring to FIG. 3, the transfer assembly 34 includes a transfer shoe 36 positioned from a drive roller 38. A pair of belts 40 extend around the drive roller 38 and the transfer shoe 36. In one embodiment, the transfer shoe 36 can be a transfer roller that rotates as the belts 40 are moved by the drive roller 38. The belts 40, when pressed against a sheet material, facilitate movement of the sheet material through the dispensing mechanism.

As shown in FIGS. 2 and 3, the transfer shoe 36 has a length that is shorter than the drive roller 38. More particularly, the transfer shoe 36 has a length that permits the transfer shoe 36 to move in between the abutment devices 32 as particularly shown in FIG. 2. During operation, for instance, the transfer shoe 36 stays in contact with a sheet material being dispensed from a roll of sheet material. The transfer shoe 36 pivots from a first position where a full roll of material is resting on the cradle roller 18 to a second position where a partially exhausted roll of sheet material rests on the collection device 30. The transfer assembly 34 can further include a transfer tab 42. The transfer tab 42 is designed to engage a spring that can be mounted, for instance, to the housing 12 for biasing the transfer shoe 36 into the first position.

Referring to FIG. 2, the dispensing mechanism further includes a pressure roller 44. The pressure roller 44 is placed adjacent to the drive roller 38 of the transfer assembly 34. A nip is formed in between the drive roller 38 and the pressure roller 44 for receiving a sheet material being dispensed. As the drive roller 38 rotates, a sheet material is conveyed through the nip and out through the dispensing opening 14.

Figure 9:
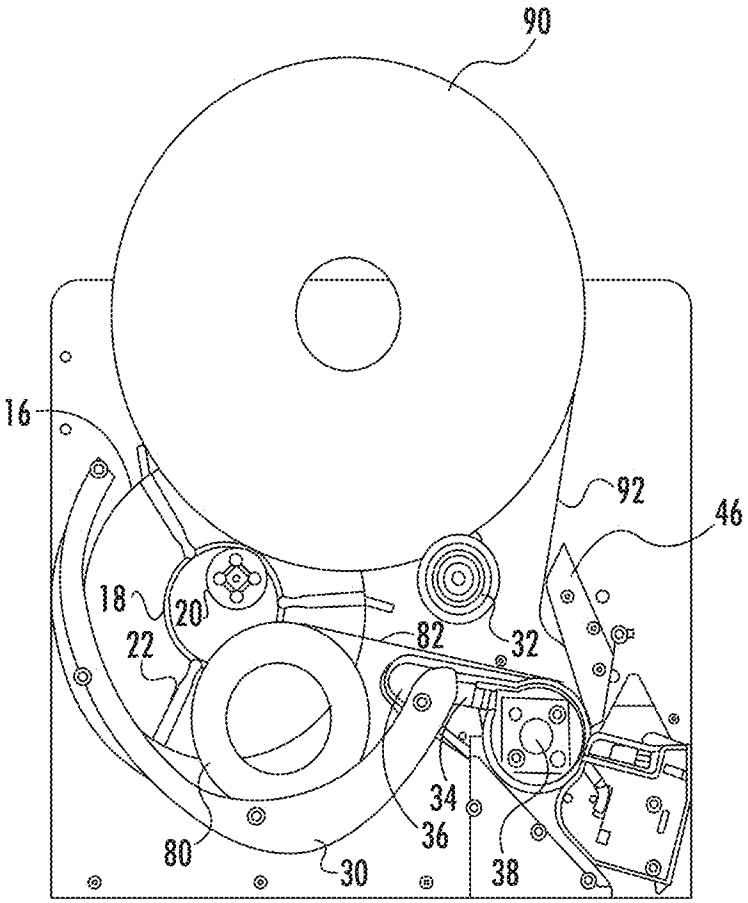
FIG. 9 is a cross-sectional view of the dispensing mechanism illustrated in FIG. 2.

The dispensing mechanism further includes a feed device 46 as shown in FIG. 2 and particularly illustrated in FIG. 9. The feed device 46 is for receiving a free end 92 of a new roll of sheet material 90. As shown in FIG. 9, as a partially unwound roll of sheet material 80 is being depleted from the collection device 30, the feed device 46 retains the free end 92 of the roll of sheet material 90. When the roll of sheet material 80 is completely depleted, the transfer shoe 36 of the transfer assembly 34 pivots back to the first position and into engagement with the free end 92 of the new roll of sheet material 90 for engaging with and dispensing the sheet material 92 from the dispenser 10.

Referring to FIGS. 6-13, operation of the dispensing mechanism is illustrated in a step-by-step manner. As shown in FIG. 6, a full roll of sheet material 80 is loaded onto the cradle device 16. In addition, the roll of sheet material 80 spans across the distance between the cradle roller 18 and the abutment devices 32. Consequently, the roll of sheet material 80 also rests against the abutment devices 32. When installing a new roll of material 80 into the dispensing mechanism without any other rolls of material present, the roll is loaded onto the cradle device 16 and the leading edge of the sheet material 82 is placed into contact with the transfer assembly 34. For example, in one aspect, an operator can place pressure on the transfer tab 42 of the transfer assembly 34 causing the transfer shoe 36 to pivot for placing the sheet material 82 in between the transfer assembly and the feed device 46. Once the leading edge 82 of the sheet material has been placed adjacent to the transfer assembly 34, a user can push a sheet feed button (not shown) to load the sheet between the drive roller 38 and the pressure roller 44. The belts 40 facilitate movement of the sheet material 82 and guide the sheet material 82 into the nip formed between the drive roller 38 and the pressure roller 44.

Once loaded into the dispenser 10, the sheet material 82 is dispensed out through the dispensing opening 14 as desired. Not shown, the dispenser can include any suitable cutting device for dispensing the sheet material 82 as individual sheets. The cutting device, for instance, can be a cutting bar that automatically cuts or perforates the material or, alternatively, a user can grasp a sheet hanging from beneath a bottom portion of the housing and pull the sheet against a cutting or tear bar such that the sheet tears and separates along a line defined by the tear or cutting bar.

The dispensing mechanism may be powered by batteries contained in the battery compartment or can be powered by an AC distribution system. If the dispenser includes batteries, a sensor can also be included for determining the power level of the batteries. In addition, the dispenser can include a controller and control circuitry. The controller and control circuitry can control and monitor all functions of the dispenser 10 including the length of the sheet of material being dispensed, product usage, and any other activities that are occurring within the dispenser. The controller can be configured to communicate information regarding the dispenser 10 to a central control system via wired means or through a web-based system.

In one embodiment, the dispenser 10 can include a sensor that is designed to detect the presence of a user in a detection zone. Once the presence of a user is detected, the dispenser 10 can be configured to automatically dispense the sheet product.

Figure 7:
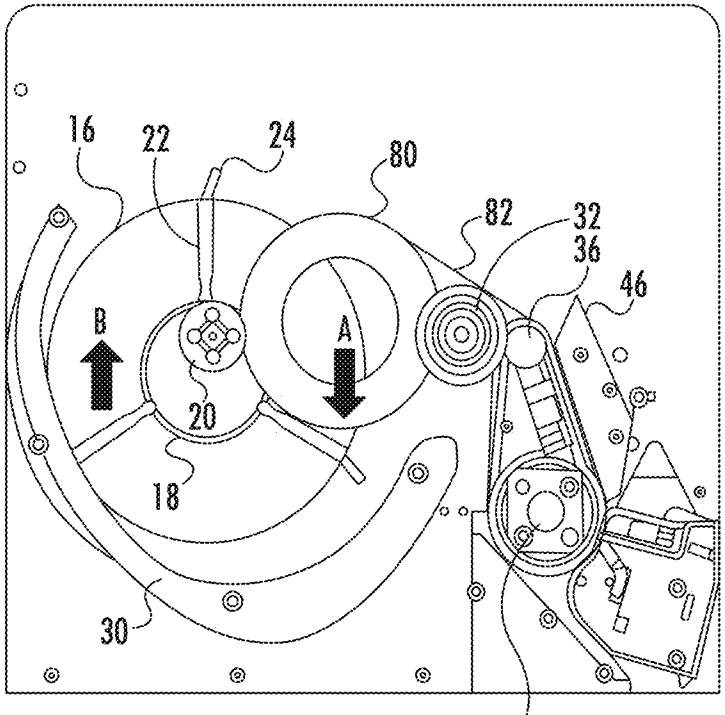
FIG. 7 is a cross-sectional view of the dispensing mechanism illustrated in FIG. 2.

As the sheet material 82 is dispensed, the diameter of the roll of material 80 decreases. For instance, as shown in FIG. 7, the roll of sheet material 80 is shown in a partially exhausted state. Ultimately, the diameter of the roll of sheet material 80 reduces to a point where the roll of sheet material 80 can drop in between the cradle roller 18 and the abutment devices 32 as particularly illustrated in FIG. 7. For example, as shown in FIG. 7, the partially exhausted roll of material 80 falls by gravity onto the collection device 30 causing the cradle roller 18 to rotate.

The distance between the cradle roller 18 and the abutment devices 32 can vary depending upon the particular application. In one embodiment, for instance, the distance can be set such that the roll of material 80 drops between the cradle roller 18 and the abutment devices 32 when the diameter of the roll is less than about 6 inches, such as less than about 5 inches, such as less than about 4 inches, and generally greater than about 2 inches, such as greater than about 2.5 inches. The distance between the cradle roller 18 and the abutment devices 32, however, can vary depending upon the type of product being dispensed. Consequently, in one embodiment, the distance between the cradle roller 18 and the abutment devices 32 may depend upon how much material has been dispensed from the roll of material 80. For example, the distance between the cradle roller 18 and the abutment devices 32 can be adjusted so that the roll of sheet material 80 drops between the two components when the roll of sheet material 80 has dispensed greater than about 50% of the roll, such as greater than about 60% of the roll, such as greater than about 70% of the roll, such as greater than about 80% of the roll, and generally less than about 95% of the roll, such as less than about 90% of the roll. In one embodiment, the abutment devices can be adjustable for adjusting the above distance.

Figure 8:
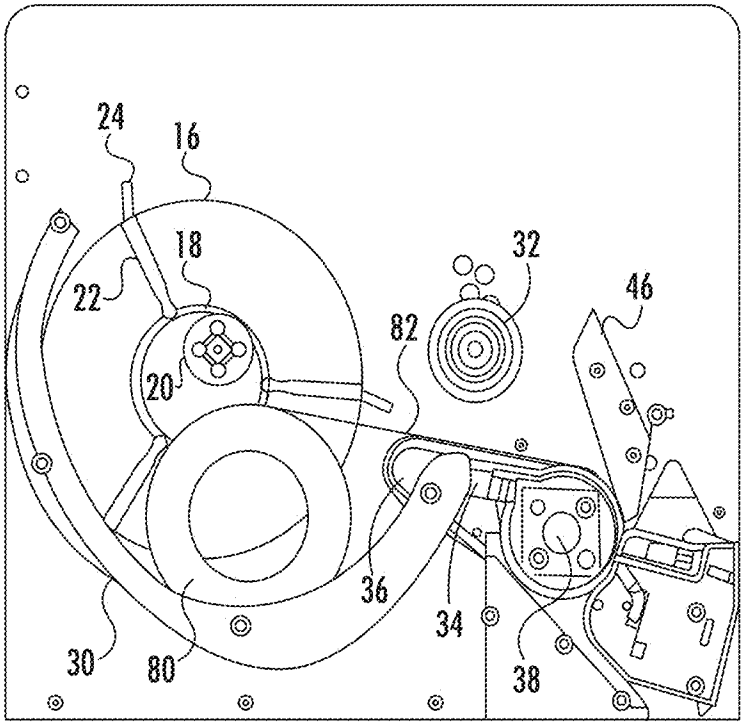
FIG. 8 is a cross-sectional view of the dispensing mechanism illustrated in FIG. 2.

As shown in FIG. 8, as the roll of material 80 drops onto the collection device 30, the sheet material 82 remains in contact with the transfer assembly 34 so that the sheet material 82 can continue to be dispensed from the new position without interruption. As described above, the transfer assembly 34 can be biased in a first or upward position adjacent to the abutment devices 32. When the roll of material 80 drops onto the collection device 30, however, the sheet material 82 applies pressure to the transfer assembly 34 and the transfer shoe 36 causing the transfer shoe 36 to pivot to a second position as shown in FIG. 8.

Figure 13:
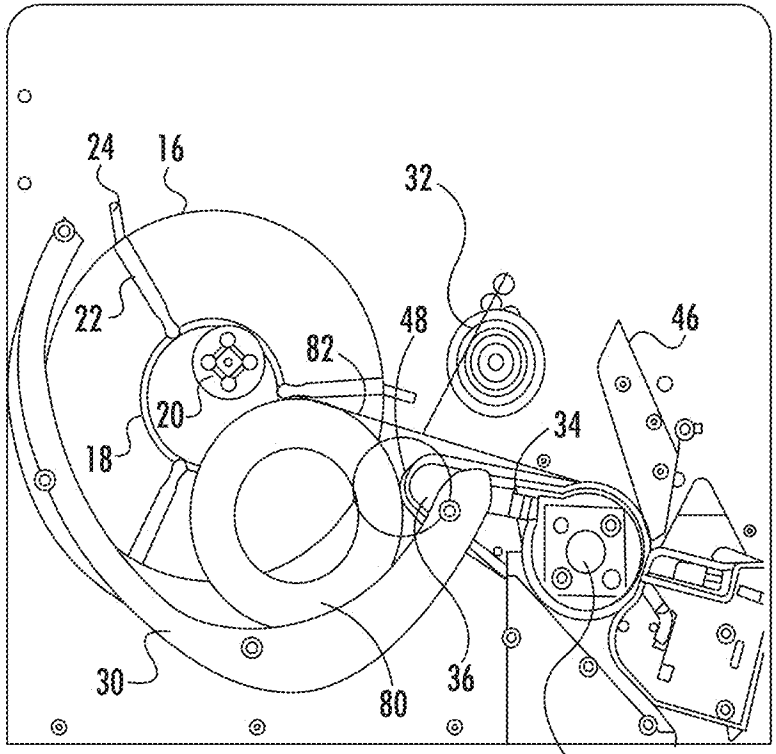
FIG. 13 is a cross-sectional view of the dispensing mechanism illustrated in FIG. 2.

As shown in FIG. 3 and FIG. 13, the transfer shoe 36 can further include a stop member 48 that protrudes from a diameter of the transfer shoe 36. The stop member 48 is designed to prevent the roll of material 80 from being pulled out of the collection device 30 when the sheet material 82 is being dispensed. For example, because the partially depleted roll of sheet material 80 is not restrained on the collection device 30, there is potential for the roll to be pulled up towards the drive mechanism. The stop member 48 in combination with the latch device 28, however, prevents the roll of sheet material 80 from being dislodged on the collection device 30 and prevents the cradle roller 18 from rotating in reverse.

Figure 10:
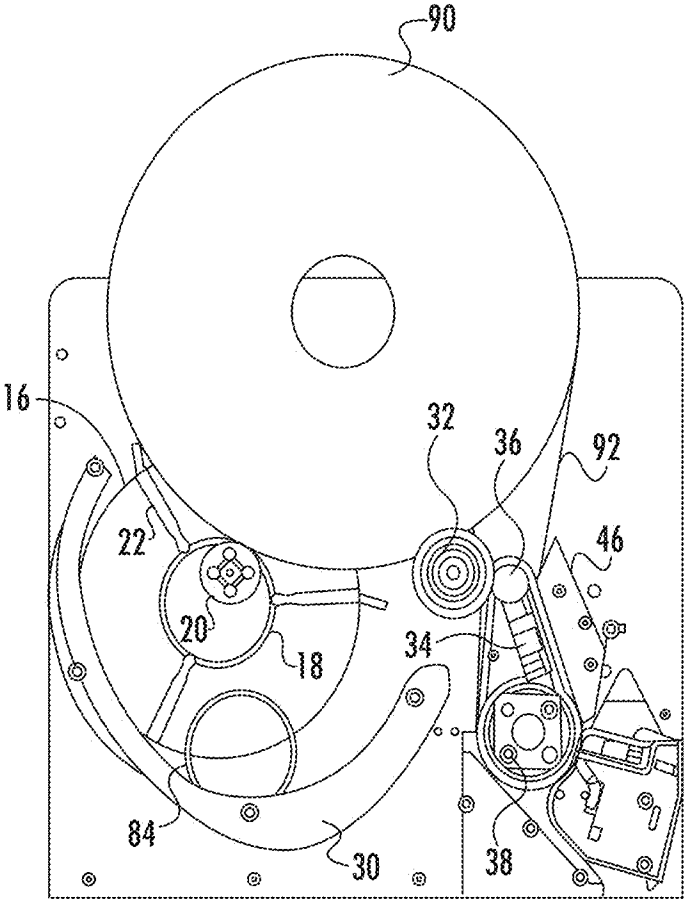
FIG. 10 is a cross-sectional view of the dispensing mechanism illustrated in FIG. 2.

When the roll of sheet material 80 drops onto the collection device 30, the dispenser is ready to receive a new roll of sheet material 90 as shown in FIG. 9. The new roll of sheet material 90 is positioned on the cradle roller 18 and against the abutment devices 32. A free end of sheet material 92 is then placed in the feed device 46 by an operator. As shown in FIG. 10, when the roll of sheet material 80 is completely depleted, an empty core 84 remains on the collection device 30. Because the sheet material 82 is no longer present within the dispenser, the transfer assembly 34 automatically pivots back to the first position adjacent to the feed device 46. In this manner, the free end of the sheet material 92 is automatically placed into contact with the transfer assembly 34 causing the sheet material 92 to be threaded through the dispenser for uninterrupted dispensing of the sheet material.

Figure 11:
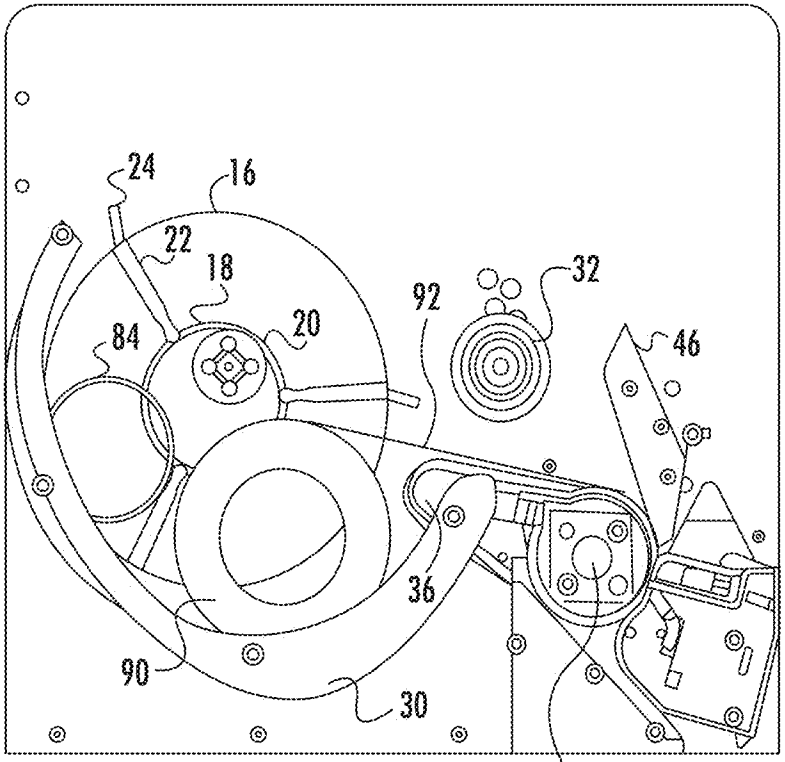
FIG. 11 is a cross-sectional view of the dispensing mechanism illustrated in FIG. 2.
Figure 12:
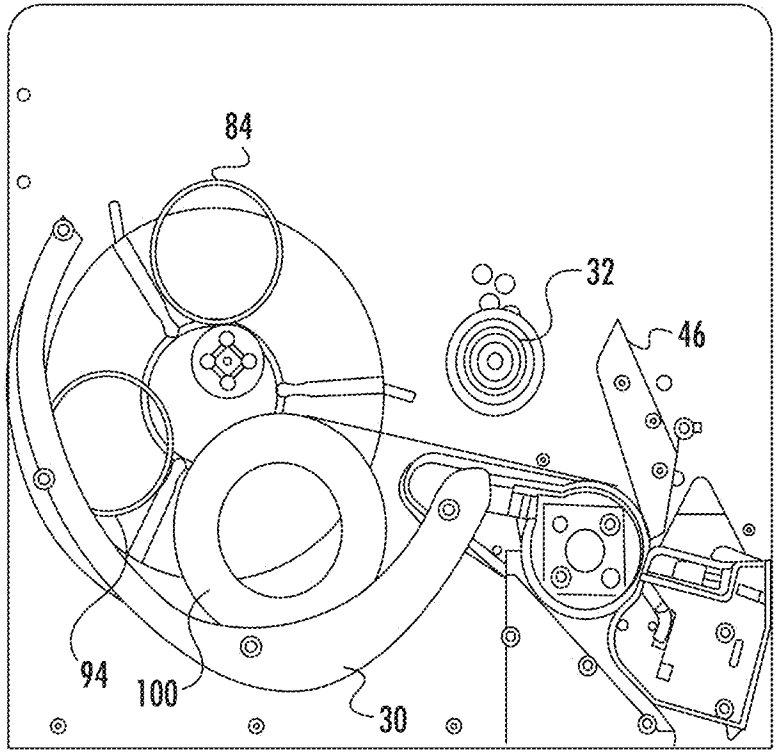
FIG. 12 is a cross-sectional view of the dispensing mechanism illustrated in FIG. 2.

As shown in FIGS. 11 and 12, once the new roll of sheet material 90 is partially exhausted, the roll of sheet material 90 falls onto the collection device 30 and the process continues to repeat. As shown in FIG. 12, empty cores 84 and 94 collect within the cradle device 16. The segregator panels 22 continue to move the empty cores 84 and 94 around the circumference of the cradle roller 18 without interfering with further dispensing of the sheet material from the roll of sheet material 100. Once positioned on the top of the cradle roller 18 as shown in FIG. 12, a core can be easily removed by an operator and a new roll of material can be loaded into the dispenser as shown in FIG. 9.

As shown in the figures, loading new rolls of material and removing empty cores is a very simple and easy process when using the dispenser 10.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for sheet materials comprising:

a housing having an interior volume so as to retain at least one roll of a sheet material; and a dispensing mechanism contained within the housing for dispensing the sheet material, the dispensing mechanism comprising:

(a) a cradle device for holding a roll of sheet material;

(b) collection device positioned below the cradle device, the collection device being positioned to receive a roll of sheet material that has been at least partially exhausted;

(c) a pair of spaced apart abutment devices spaced from the cradle device, wherein a roll of sheet material loaded onto the cradle device rests against the abutment devices and as sheet material is dispensed, a diameter of the roll of sheet material reduces until the roll of sheet material drops between the cradle device and the abutment devices and onto the collection device; and (d) a transfer assembly that guides a sheet material from a roll of sheet material loaded on the cradle device out through a dispensing opening, the transfer assembly including a transfer shoe spaced from a drive roller, the transfer shoe guiding the sheet material into operative engagement with the drive roller for dispensing the sheet material from the dispenser, and wherein the transfer assembly pivots when a roll of sheet material drops between the cradle device and the abutment devices for continuing to dispense sheet material from the partially exhausted roll of material.

2. A dispenser as defined in claim 1, wherein the cradle device includes a cradle roller mounted and rotatable on an axial member.

3. A dispenser as defined in claim 2, wherein the cradle device further includes spaced apart segregator panels, the segregator panels being spaced apart a distance sufficient for a roll of sheet material to be positioned therebetween.

4. A dispenser as defined in claim 2, wherein the cradle device further comprises a latch device that only permits the cradle roller to rotate towards the transfer assembly as a roll of sheet material is depleted and drops onto the collection device.

5. A dispenser as defined in claim 3, wherein each segregator panel includes a segregator panel tab that protrudes axially outwards from the cradle roller, the segregator panel tabs being configured to engage with an alignment channel located on the collection device for maintaining the cradle roller in axial alignment.

6. A dispenser as defined in claim 1, wherein the collection device comprises an arc-shaped pan that partially surrounds the cradle device, the collection device having a shape sufficient to hold a plurality of cores collected from fully dispensed rolls of sheet material.

7. A dispenser as defined in claim 1, wherein the transfer assembly includes at least one belt that extends around the drive roller and the transfer shoe, the belt being driven by the drive roller and, when pressed against a sheet material, facilitates movement of the sheet material through the dispenser.

8. A dispenser as defined in claim 1, wherein the transfer shoe comprises a transfer roller.

9. A dispenser as defined in claim 1, wherein the dispensing mechanism further includes a pressure roller positioned adjacent to the drive roller, wherein the transfer assembly guides a sheet material into a nip formed between the pressure roller and the drive roller for dispensing the sheet material through the dispensing opening.

10. A dispenser as defined in claim 1, wherein the transfer shoe has a size that passes in between the abutment devices when a roll of sheet material drops between the cradle device and the abutment devices and the transfer assembly pivots.

11. A dispenser as defined in claim 1, wherein the transfer shoe moves from a first position to a second position when the transfer assembly pivots due to a roll of material dropping between the cradle device and the abutment devices and wherein the transfer shoe is biased towards the first position and when a roll of material drops between the cradle device and the abutment devices, the sheet of material pushes against the transfer shoe and moves the transfer shoe into the second position.

12. A dispenser as defined in claim 11, wherein, when a roll of material held on the collection device is completely depleted, the transfer shoe pivots back to the first position.

13. A dispenser as defined in claim 1, wherein the transfer shoe includes a stopping member that is positioned to prevent a partially exhausted roll of sheet material located on the collection device from being displaced from the collection device.

14. A dispenser as defined in claim 1, wherein the dispensing mechanism further comprises a feed device for receiving a free end of a roll of sheet material loaded on the cradle device, wherein the feed device automatically feeds the free end of the roll of sheet material into the transfer assembly when a roll of material on the collection device is completely depleted.

15. A method of dispensing a roll of sheet material comprising:

loading a roll of sheet material onto a cradle device, the roll of sheet material resting against a surface of the cradle device and against a pair of spaced apart abutment devices;

dispensing the sheet material from the roll of material through a dispensing opening and wherein, as the roll of material dispenses, a diameter of the roll of material decreases to an extent that the roll of material drops in between the cradle device and the abutment devices and onto a collection device; and continuing to dispense the roll of material from the collection device uninterrupted until the roll of material is completely depleted.

16. A method as defined in claim 15, further comprising the step of guiding the sheet material through a transfer device for dispensing the sheet material through the dispensing opening, the transfer device pivoting from a first position to a second position when the roll of material drops between the cradle device and the abutment devices onto the collection device, the transfer device including a transfer shoe that moves in between the abutment devices and stays in contact with the sheet material as the roll of material drops.

17. A method as defined in claim 15, further comprising the step of loading a second roll of material onto the cradle device after the first roll of material has dropped onto the collection device, the method further comprising the step of automatically dispensing a sheet material from the second roll of material when the first roll of material has been completely depleted.

18. A method as defined in claim 15, wherein as the diameter of the roll of material decreases, the roll of material causes the cradle device to rotate allowing the roll of material to fall onto the collection device by gravity.

19. A method as defined in claim 15, wherein the spaced apart abutment devices comprise a pair of spaced apart abutment rollers on which the roll of material rotates as the sheet material is dispensed.

20. A method as defined in claim 15, wherein the sheet material comprises a paper towel.

* * * * *